US007867740B2

(12) United States Patent
Vieille et al.

(10) Patent No.: US 7,867,740 B2
(45) Date of Patent: Jan. 11, 2011

(54) ***THERMOTOGA MARITIMA* MANNITOL DEHYDROGENASE**

(75) Inventors: Claire Vieille, Lansing, MI (US); Seung Hoon Song, East Lansing, MI (US); J. Gregory Zeikus, Okemos, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 823 days.

(21) Appl. No.: 11/891,569

(22) Filed: Aug. 10, 2007

(65) Prior Publication Data

US 2008/0035490 A1 Feb. 14, 2008

Related U.S. Application Data

(60) Provisional application No. 60/837,039, filed on Aug. 11, 2006.

(51) Int. Cl.
*C12P 7/18* (2006.01)
*C12M 1/00* (2006.01)

(52) U.S. Cl. ..... 435/158; 435/175; 435/189; 204/403.1; 204/403.14; 205/777.5

(58) Field of Classification Search ..... 435/158, 435/175, 189; 204/403.1, 403.14; 205/777.5
See application file for complete search history.

(56) References Cited

U.S. PATENT DOCUMENTS

| | | | | |
|---|---|---|---|---|
| 5,935,837 | A | 8/1999 | Rasmussen | |
| 7,198,933 | B2 | 4/2007 | Zeikus et al. | |
| 2006/0134765 | A1 * | 6/2006 | Saha et al. | 435/158 |

FOREIGN PATENT DOCUMENTS

JP 56087853 A * 7/1981

OTHER PUBLICATIONS

STN abstract for JP 56087853 downloaded from CAPLUS on Aug. 26, 2010.*
Yamanaka, K. Methods in Enzymology (1975) 41: 138-142.*
Long et al. J. Electroanal. Chem. (1997) 440: 239-242.*
Kaup, B. Berischte des Forchungszentrums Juelich (2004) Juel-4155, i-iv: 1-104; STN abstract, downloaded from CAPLUS Aug. 29, 2010.*
Song et al. Appl. Microbiol. Biotechnol. (2008) 81: 485-495.*

* cited by examiner

*Primary Examiner*—Sandra Saucier
*Assistant Examiner*—Susan Hanley
(74) *Attorney, Agent, or Firm*—Ian C. McLeod; Steven M. Parks

(57) ABSTRACT

Nucleic acids encoding *Thermotoga maritima* mannitol dehydrogenase and the *Thermotoga maritima* mannitol dehydrogenase polypeptide are disclosed. Further provided are an electrochemical bioreactor system and a bioreactor electrode that can be used to convert glucose or fructose to mannitol.

12 Claims, 1 Drawing Sheet

>*Thermotoga maritima* mannitol dehydrogenase gene
ATGAAAGTACTTTTGATAGAAAAACCCGGTGTTGCGAGTGTTGTGGAGAAAGAGATACCCGTTCCCGGTGA
AGATCAGACCCTCGTGAAAGTACTCGCGTGCGGTATCTGTGGAACCGACTACAAGATATTCTCAGGAGGCA
CCAACGCCAACTATCCAGTTGTTCCAGGGCATGAGATCGTCGGCGTCGTTGAAAGATCGGGTGTTTTCGAA
AAGGGGCAGATGGTTGTGATCGATCCCAACAGATCCTGTGGGAAGTGTGACTACTGTAGAAAAGGTATGTC
TCAGTTCTGTGAAAACCTTCAGGCAACGGGCGTGACAGAACCAGGAGGATTTGCGGAATACGTGCTCGTGG
AGAACTCACAGGTTTATCCTGTGAGAAATGTACCCGCAGAGAGAGCCGTTTTCGCAGAACCGCTTTCCTGT
GTTCTCGAAGGAGTGAAGATGGTGAAACATGGATTCTACGACAGAATCCTCGTAGTCGGAGCAGGTAGTAT
AGGTGTGATTTTTGGTCTGATCTTCAAGAAAATTTTTCCGGGTGCAGAAATAGTCCTTGCGGAGAAAGACG
AGAAACGTGCGGAATACGTTGTGCAAACTTTTGGATTGAAAGTGGATGAACCAAAAGGAGAGTACGATCTT
ACTGTCGAGTGTTCTGGTACGGTGGAAGGGTTCAAAACTTGCTTTGAACACACAGGAAAAGGTGGAATGCT
CCTTCAGTTCAGCGTCATCTCCAAAGACAAGATGGTTGAGATCTCACCGTTCGAGATCTACCGAAAGGAGA
TGAAAATACTCGGGTCCTATCTCAATCCTTTCACAATGAAAGAAGCGGTGAAGATCATAGAATCTGGAGAG
TTTCCCTTCGAAAAACTTGTCACCGATCGTCTGGATCTTGAAGGGGTGAAAGAATACCTGTCGTCTCACAA
AAAGGCATTGATGAAGGGAATTTTTTCTTAA

FIGURE 1

> *Thermotoga maritima* mannitol dehydrogenase enzyme
MKVLLIEKPGVASVVEKEIPVPGEDQTLVKVLACGICGTDYKIFSGGTNANYPVVPGHE
IVGVVERSGVFEKGQMVVIDPNRSCGKCDYCRKGMSQFCENLQATGVTEPGGFAEYVLV
ENSQVYPVRNVPAERAVFAEPLSCVLEGVKMVKHGFYDRILVVGAGSIGVIFGLIFKKI
FPGAEIVLAEKDEKRAEYVVQTFGLKVDEPKGEYDLTVECSGTVEGFKTCFEHTGKGGM
LLQFSVISKDKMVEISPFEIYRKEMKILGSYLNPFTMKEAVKIIESGEFPFEKLVTDRL
DLEGVKEYLS

FIGURE 2

*THERMOTOGA MARITIMA* MANNITOL DEHYDROGENASE

CROSS-REFERENCE TO RELATED APPLICATIONS

This application claims benefit to U.S. Provisional Application Ser. No. 60/837,039, filed Aug. 11, 2006, which is incorporated herein by reference in its entirety.

STATEMENT REGARDING FEDERALLY SPONSORED RESEARCH OR DEVELOPMENT

This work was supported by a grant from the U.S. Department of Agriculture (USDA). The U.S. government has certain rights to this invention.

BACKGROUND OF THE INVENTION (1) Field of the Invention

The present invention relates generally to a thermostable mannitol dehydrogenase from *Thermotoga maritima*. Specifically, the present invention relates to the use of this enzyme on a bioreactor electrode in a bioreactor system to produce mannitol from glucose or fructose.

(2) Description of the Related Art

Currently, 50,000 tons/year of mannitol are produced by hydrogenation of a 50% fructose/50% glucose syrup at high pressures and temperatures using a Raney nickel catalyst. The fructose/glucose syrup is converted to a 30% mannitol-70% sorbitol mixture from which mannitol is purified by low-temperature crystallization. Developing a new, simplified, enzyme-catalyzed process for mannitol production could lower product costs. By starting from 100% glucose, it would increase the chemical yield (one mole mannitol produced per mole of glucose), and lower the downstream processing costs by eliminating the crystallization step. It would also allow mannitol to be called a natural product.

Mannitol is used as a low-caloric and low-cariogenic sweetener (in particular in diabetic foodstuffs), as a pharmaceutical formulating agent (e.g., used as a diuretic in the manufacture of intravenous fluids and tablets, in dental hygiene products, and as a low reactivity drug filler), as a specialty chemical, and in plastic manufacturing. SpecChem Online estimates the global market for mannitol to be about $28 million (www.specchemonline.com, Sugaring the pill, Oct. 21, 2004).

While the related art teaches mannitol production, there still exists a need for an improved method of producing mannitol.

OBJECTS

It is an object of the present invention to provide a thermostable mannitol dehydrogenase which is immobilized on a bioreactor electrode and used in an electrochemical bioreactor system to produce mannitol. It is also an object to provide a process which is reliable and economically favorable for producing mannitol. These and other objects will become increasingly apparent by reference to the following description and the drawings.

SUMMARY OF THE INVENTION

The present invention provides a bioreactor electrode comprising: an electrode substrate having an exposed surface; a first thermostable enzyme having a mannitol dehydrogenase activity immobilized on the surface of the electrode substrate; and a second thermostable enzyme having a xylose isomerase activity immobilized on the surface of the electrode substrate, wherein the first enzyme and the second enzyme convert glucose to mannitol when used in an electrochemical bioreactor system. In further embodiments, the first thermostable enzyme is *Thermotoga maritima* mannitol dehydrogenase. In still further embodiments, the second thermostable enzyme is *Thermotoga neapolitana* xylose isomerase. Further still, preferably the first thermostable enzyme is *Thermotoga maritima* mannitol dehydrogenase and the second thermostable enzyme is *Thermotoga neapolitana* xylose isomerase. Further, preferably NADH or NADPH is immobilized on the electrode.

The present invention provides an electrochemical bioreactor system comprising: a glucose solution; an electrochemical reactor electrode in the glucose solution comprising an electrode substrate having an exposed surface; a first thermostable enzyme having a mannitol dehydrogenase activity immobilized on the surface of the electrode substrate; a second thermostable enzyme having a xylose isomerase activity immobilized on the surface of the electrode substrate, wherein the first enzyme and the second enzyme convert glucose to mannitol when used in an electrochemical reactor system; a cofactor comprising NADH or NADPH; and a power source electrically connected to the electrochemical reactor electrode, wherein when the power source provides an electrical current the cofactor is recycled so that the glucose in the glucose solution is converted to mannitol. Further still, preferably the NADH or NADPH is immobilized on the electrode substrate. Still further, the first thermostable enzyme is *Thermotoga maritima* mannitol dehydrogenase and the second thermostable enzyme is *Thermotoga neapolitana* xylose isomerase.

Further, the present invention provides a process for producing mannitol which comprises: a glucose solution; an electrochemical reactor electrode in the glucose solution comprising an electrode substrate having an exposed surface; a first thermostable enzyme having a mannitol dehydrogenase activity immobilized on the surface of the electrode substrate; a second thermostable enzyme having a xylose isomerase activity immobilized on the surface of the electrode substrate, wherein the first enzyme and the second enzyme convert glucose to mannitol when used in an electrochemical reactor system; a cofactor comprising NADH or NADPH; and a power source electrically connected to the electrochemical reactor electrode, wherein when the power source provides an electrical current the cofactor is recycled so that the glucose in the glucose solution is converted to mannitol; and introducing the electrical current from the power source to produce the mannitol from the glucose. Further, the first thermostable enzyme is preferably *Thermotoga maritima* mannitol dehydrogenase. Still further, preferably the second thermostable enzyme is *Thermotoga neapolitana* xylose isomerase. Further still, preferably the first thermostable enzyme comprises a polypeptide having the amino acid sequence of SEQ ID NO 2. Further, the NADH or NADPH is immobilized on the substrate. Still further, preferably the first thermostable enzyme is *Thermotoga maritima* mannitol dehydrogenase and the second thermostable enzyme is *Thermotoga neapolitana* xylose isomerase. Further, preferably the second thermostable enzyme is *Thermotoga neapolitana* xylose isomerase containing mutations V186T, L283P, and F187S.

In further embodiments, a bioreactor electrode comprising: an electrode substrate having an exposed surface; a thermostable enzyme having a mannitol dehydrogenase activity immobilized on the surface of the electrode substrate; and wherein the enzyme converts fructose to mannitol when used in an electrochemical bioreactor system. Further, the thermostable enzyme is preferably *Thermotoga maritima* mannitol dehydrogenase. Still further, the enzyme comprises the amino acid sequence of SEQ ID NO 2. Further still, the invention relates to a process for producing mannitol which comprises using the electrode to convert fructose to mannitol. Finally, the invention relates to a system for producing mannitol which comprises using the system to produce the mannitol from a glucose isomerase mixture.

BRIEF DESCRIPTION OF THE DRAWINGS

FIG. 1 is a drawing showing SEQ ID NO 1.
FIG. 2 is a drawing showing SEQ ID NO 2.

DETAILED DESCRIPTION OF THE INVENTION

All patents, patent applications, government publications, government regulations, and literature references cited in this specification are hereby incorporated herein by reference in their entirety. In case of conflict, the present description, including definitions, will control.

*Thermotoga neapolitana* xylose isomerase is described in U.S. Pat. No. 7,198,933 to Zeikus et al. hereby incorporated herein by reference in its entirety. *Thermotoga neapolitana* xylose isomerase containing mutations V186T, L283P, and F187S is described in the '933 patent. The strains *Thermotoga maritima* DSM 3109, the strains *Thermotoga elfii* DSM 9442 and ATCC 51869, and the strains *Thermotoga neapolitana* DSM 4359 and ATCC 49049 are described in U.S. Patent No. 5,935,837 to Rasmussen hereby incorporated herein by reference in its entirety. Rasmussen teaches *Thermotoga maritima* xylose isomerase, useful for the electrochemical bioreactor system of the present invention. Xylose isomerase also known as glucose isomerase is well known to those skilled in the art.

The present invention provides a gene encoding thermostable mannitol dehydrogenase from *Thermotoga maritima* and use of the enzyme in a bioreactor system to produce mannitol from glucose. The present invention replaces the current synthetic mannitol production process by the use of an enzyme catalyzed process. For this purpose, a thermostable mannitol dehydrogenase has been cloned and characterized which is used to produce mannitol from fructose or, from glucose in a bioelectrochemical reactor. Used alone, this enzyme is able to produce mannitol from a fructose syrup. Used in combination with a thermostable xylose isomerase (glucose isomerase), this enzyme would be able to produce mannitol directly from a glucose syrup.

EXAMPLE

The *T. maritima* mannitol dehydrogenase gene was obtained by DNA amplification using *T. maritima* (MSB8) genomic DNA as the template and oligonucleotides 5'-CG CATATGAAAGTACTTTTGATAG-3' (where CATATG creates an NdeI site) (SEQ ID NO. 3) and 5'-CT CTCGAGAGAAAAAATTCCCTTCATC-3' (where CTCGAG creates a XhoI site) (SEQ ID NO. 4) as the primers. The PCR product has cloned into the NdeI and XhoI sites of pET24(a)+(Novagen) and transformed into *Escherichia coli* BL21(DE3) for protein expression. In this construct, the recombinant *T. maritima* mannitol dehydrogenase was expressed as a fusion protein with a C-terminal $(His)_6$ tag. The recombinant *T. maritima* mannitol dehydrogenase was routinely over expressed in *E. coli* by growing cultures in SB medium and inducing with IPTG (0.6 mM) when $OD_{600}$ reaches 1.4. Expression was induced for sixteen (16) hours. After resuspension in 50 mM Tris-HCl pH 8.5 containing 10 mM β-mercaptoethanol (buffer A), the bacteria were lysed using a French pressure cell, the crude extract was centrifuged for 40 min. at 25,000×g, the supernatant was heat treated at 85° C. for 20 min. to denature most *E. coli* proteins, the heat-treated extract was centrifuged for 20 min. at 20,000×g, and the supernatant was finally purified on a Ni-NTA affinity column.

The recombinant *T. maritima* mannitol dehydrogenase expression and purification systems are currently acceptable for routine bench-top scale preparations, biochemical characterization, and testing in prototype bioelectrochemical reactors. Activity levels on fructose as the substrate and with NADH as the cofactor can be increased by mutagenesis to make this enzyme even more performing for industrial mannitol production. In particular, the affinity for fructose relative to mannitol can be increased. Since the three-dimensional structure of mannitol dehydrogenase is unknown, random mutagenesis can be used followed by screening for activity at room temperature to select for *T. maritima* mannitol dehydrogenase derivatives with increased activity levels.

It is possible to convert 100% fructose into 100% mannitol using an immobilized enzyme system, as it is done today for fructose syrup (42%) production in an immobilized glucose isomerase reactor. Fructose is more expensive than glucose, though, and it is produced directly from glucose. Since a large selection of thermostable glucose isomerases is available, one can also produce the mannitol dehydrogenase bioreactor. Such a system with the robust thermostable mannitol dehydrogenase can be used with the pyrimidine nucleotide cofactor which can be easily recycled. By using electrochemical recycling, glucose can be converted stoichiometrically into mannitol in a single electrochemical reactor system at 60° C. containing both immobilized thermostable mannitol dehydrogenase (MtDH) and glucose isomerase.

An NAD-dependent thermostable mannitol dehydrogenase was cloned. *T. maritima* mannitol dehydrogenase is increasingly active up to 90° C. The enzyme shows four times higher affinity for NADH than for NADPH. The optimum pH for fructose reduction is 6.0 and the optimum pH for mannitol oxidation is 8.3. When co-immobilized on an electrochemical reactor's electrode, this enzyme and a thermostable xylose isomerase are able to produce mannitol directly from glucose when the cofactor is recycled using electrons provided by an electrical current.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the claims attached herein.

SEQUENCE LISTING

<160> NUMBER OF SEQ ID NOS: 4

<210> SEQ ID NO 1
<211> LENGTH: 954
<212> TYPE: DNA
<213> ORGANISM: Thermotoga maritima

<400> SEQUENCE: 1 atgaaagtac ttttgataga aaaacccggt gttgcgagtg ttgtggagaa agagataccc 60 gttcccggtg aagatcagac cctcgtgaaa gtactcgcgt gcggtatctg tggaaccgac 120 tacaagatat tctcaggagg caccaacgcc aactatccag ttgttccagg gcatgagatc 180 gtcggcgtcg ttgaaagatc gggtgttttc gaaaaggggc agatggttgt gatcgatccc 240 aacagatcct gtgggaagtg tgactactgt agaaaaggta tgtctcagtt ctgtgaaaac 300 cttcaggcaa cgggcgtgac agaaccagga ggatttgcgg aatacgtgct cgtggagaac 360 tcacaggttt atcctgtgag aaatgtaccc gcagagagag ccgttttcgc agaaccgctt 420 tcctgtgttc tcgaaggagt gaagatggtg aaacatggat tctacgacag aatcctcgta 480 gtcggagcag gtagtatagg tgtgattttt ggtctgatct tcaagaaaat ttttccgggt 540 gcagaaatag tccttgcgga gaaagacgag aaacgtgcgg aatacgttgt gcaaactttt 600 ggattgaaag tggatgaacc aaaaggagag tacgatctta ctgtcgagtg ttctggtacg 660 gtggaagggt tcaaaacttg ctttgaacac acaggaaaag gtggaatgct ccttcagttc 720 agcgtcatct ccaaagacaa gatggttgag atctcaccgt tcgagatcta ccgaaaggag 780 atgaaaatac tcgggtccta tctcaatcct ttcacaatga aagaagcggt gaagatcata 840 gaatctggag agtttccctt cgaaaaactt gtcaccgatc gtctggatct tgaaggggtg 900 aaagaatacc tgtcgtctca caaaaaggca ttgatgaagg gaatttttc ttaa 954

<210> SEQ ID NO 2
<211> LENGTH: 317
<212> TYPE: PRT
<213> ORGANISM: Thermotoga maritima

<400> SEQUENCE: 2

Met Lys Val Leu Leu Ile Glu Lys Pro Gly Val Ala Ser Val Val Glu
1 5 10 15

Lys Glu Ile Pro Val Pro Gly Glu Asp Gln Thr Leu Val Lys Val Leu
20 25 30

Ala Cys Gly Ile Cys Gly Thr Asp Tyr Lys Ile Phe Ser Gly Gly Thr
35 40 45

Asn Ala Asn Tyr Pro Val Val Pro Gly His Glu Ile Val Gly Val Val
50 55 60

Glu Arg Ser Gly Val Phe Glu Lys Gly Gln Met Val Val Ile Asp Pro
65 70 75 80

Asn Arg Ser Cys Gly Lys Cys Asp Tyr Cys Arg Lys Gly Met Ser Gln
85 90 95

Phe Cys Glu Asn Leu Gln Ala Thr Gly Val Thr Glu Pro Gly Gly Phe
100 105 110

Ala Glu Tyr Val Leu Val Glu Asn Ser Gln Val Tyr Pro Val Arg Asn
115 120 125

Val Pro Ala Glu Arg Ala Val Phe Ala Glu Pro Leu Ser Cys Val Leu
130 135 140

-continued

```
Glu Gly Val Lys Met Val Lys His Gly Phe Tyr Asp Arg Ile Leu Val
145                 150                 155                 160

Val Gly Ala Gly Ser Ile Gly Val Ile Phe Gly Leu Ile Phe Lys Lys
                165                 170                 175

Ile Phe Pro Gly Ala Glu Ile Val Leu Ala Glu Lys Asp Glu Lys Arg
            180                 185                 190

Ala Glu Tyr Val Val Gln Thr Phe Gly Leu Lys Val Asp Glu Pro Lys
        195                 200                 205

Gly Glu Tyr Asp Leu Thr Val Glu Cys Ser Gly Thr Val Glu Gly Phe
    210                 215                 220

Lys Thr Cys Phe Glu His Thr Gly Lys Gly Gly Met Leu Leu Gln Phe
225                 230                 235                 240

Ser Val Ile Ser Lys Asp Lys Met Val Glu Ile Ser Pro Phe Glu Ile
                245                 250                 255

Tyr Arg Lys Glu Met Lys Ile Leu Gly Ser Tyr Leu Asn Pro Phe Thr
            260                 265                 270

Met Lys Glu Ala Val Lys Ile Ile Glu Ser Gly Glu Phe Pro Phe Glu
        275                 280                 285

Lys Leu Val Thr Asp Arg Leu Asp Leu Glu Gly Val Lys Glu Tyr Leu
    290                 295                 300

Ser Ser His Lys Lys Ala Leu Met Lys Gly Ile Phe Ser
305                 310                 315


<210> SEQ ID NO 3
<211> LENGTH: 24
<212> TYPE: DNA
<213> ORGANISM: Artificial Sequence
<220> FEATURE:
<223> OTHER INFORMATION: Description of Artificial Sequence:  Synthetic
      oligonucleotide primer

<400> SEQUENCE: 3

cgcatatgaa agtacttttg atag                                          24


<210> SEQ ID NO 4
<211> LENGTH: 27
<212> TYPE: DNA
<213> ORGANISM: Artificial Sequence
<220> FEATURE:
<223> OTHER INFORMATION: Description of Artificial Sequence:  Synthetic
      oligonucleotide primer

<400> SEQUENCE: 4

ctctcgagag aaaaaattcc cttcatc                                       27
```

We claim:

1. A bioreactor electrode comprising:

(a) an electrode substrate having an exposed surface;

(b) a first thermostable enzyme having a mannitol dehydrogenase activity derived from *Thermotoga maritima* immobilized on the surface of the electrode substrate; and (c) a second thermostable enzyme having a xylose isomerase activity derived from *Thermotoga neapolitana* immobilized on the surface of the electrode substrate, wherein the first enzyme and the second enzyme convert glucose to mannitol when used in an electrochemical bioreactor system.

2. The electrode of claims 1 further comprising NADH or NADPH that is immobilized on the surface of the electrode substrate.

3. An electrochemical bioreactor system comprising:

(a) a glucose solution;

(b) an electrochemical reactor electrode in the glucose solution comprising an electrode substrate having an exposed surface; a first thermostable enzyme having a mannitol dehydrogenase activity derived from *Thermotoga maritima* immobilized on the surface of the electrode substrate; a second thermostable enzyme having a xylose isomerase activity derived from *Thermotoga neapolitana* immobilized on the surface of the electrode substrate, wherein the first enzyme and the second enzyme convert glucose to mannitol when used in an electrochemical reactor system;

(c) a cofactor comprising NADH or NADPH; and (d) a power source electrically connected to the electrochemical reactor electrode, wherein when the power source provides an electrical current, the cofactor is recycled so that the glucose in the glucose solution is converted to mannitol.

4. The system of claim 3 wherein the NADH or NADPH is immobilized on the surface of the electrode substrate.

5. The system of claim 3 wherein the second thermostable enzyme is *Thermotoga neapolitana* xylose isomerase containing mutations V186T, L283P, and F187S.

6. A process for producing mannitol which comprises:

(a) providing a glucose solution; an electrochemical reactor electrode in the glucose solution comprising an electrode substrate having an exposed surface; a first thermostable enzyme having a mannitol dehydrogenase activity derived from *Thermotoga maritima* immobilized on the surface of the electrode substrate; a second thermostable enzyme having a xylose isomerase activity derived from *Thermotoga neapolitana* immobilized on the surface of the electrode substrate, wherein the first enzyme and the second enzyme convert glucose to mannitol when used in an electrochemical reactor system; a cofactor comprising NADH or NADPH; and a power source electrically connected to the electrochemical reactor electrode, wherein when the power source provides an electrical current, the cofactor is recycled so that the glucose in the glucose solution is converted to mannitol; and (b) introducing the electrical current from the power source to produce the mannitol from the glucose.

7. The process of claim 6 wherein the first thermostable enzyme comprises a polypeptide having the amino acid sequence of SEQ ID. NO. 2.

8. The process of claim 6 or 7 wherein the NADH or NADPH is immobilized on the surface of the electrode substrate.

9. The process of claim 6 wherein the second thermostable enzyme is *Thermotoga neapolitana* xylose isomerase containing mutations V186T, L283P, and F187S.

10. A bioreactor electrode comprising:

(a) an electrode substrate having an exposed surface;

(b) a thermostable enzyme having a mannitol dehydrogenase activity derived from *Thermotoga maritima* immobilized on the surface of the electrode substrate, wherein the enzyme converts fructose to mannitol when used in an electrochemical bioreactor system.

11. The bioreactor electrode of claim 10 wherein the enzyme comprises the amino acid sequence of SEQ ID. NO. 2.

12. A process for producing mannitol from fructose which comprises (a) providing a fructose solution; an electrochemical reactor electrode in the fructose solution comprising an electrode substrate having an exposed surface; a thermostable enzyme having a mannitol dehydrogenase activity derived from *Thermotoga maritima* immobilized on the surface of the electrode substrate; wherein the enzyme converts fructose to mannitol when used in an electrochemical reactor system; a cofactor comprising NADH or NADPH; and a power source electrically connected to the electrochemical reactor electrode, wherein when the power source provides an electrical current the cofactor is recycled so that the fructose in the fructose solution is converted to mannitol; and (b) introducing the electrical current from the power source to produce the mannitol from the fructose.

* * * * *